US005657772A

United States Patent [19]

Duke et al.

[11] Patent Number: 5,657,772

[45] Date of Patent: Aug. 19, 1997

[54] SMOKING ARTICLE AND FILTER THEREFOR

[75] Inventors: Martin Graham Duke, Maldon; Edward Dennis John, Basildon, both of England

[73] Assignee: Rothmans International Services Limited, London, England

[21] Appl. No.: 354,678

[22] Filed: Dec. 13, 1994

[30] Foreign Application Priority Data

Dec. 14, 1993 [GB] United Kingdom ..... 9325536

[51] Int. Cl.[6] ..... A24D 3/06; A24D 3/12

[52] U.S. Cl. ..... 131/334

[58] Field of Search ..... 131/334, 331

[56] References Cited

U.S. PATENT DOCUMENTS

| | | | |
|---|---|---|---|
| 4,317,460 | 3/1982 | Dale et al. | 131/334 |
| 5,446,003 | 8/1995 | Augustine et al. | 131/334 X |

FOREIGN PATENT DOCUMENTS

| | | | |
|---|---|---|---|
| 0022276 | 2/1979 | Japan | 131/334 |
| 82-011630 | 3/1982 | Japan . | |
| 2042364 | 9/1980 | United Kingdom | 131/334 |

OTHER PUBLICATIONS

Reynolds, J.W., "Results Of Experimental Work To Remove CO From A Mixture Of $O_2$And $N_2$By Use Of Modified Cigarette filters, Research Laboratories/Tennessee Eastman Company", Mar. 1978 .

*Primary Examiner*—Jennifer Bahr

[57] ABSTRACT

A filter for a smoking article incorporating particles coated with platinum selectively reduces the amount of volatiles of mainstream smoking article smoke passing through the filter. The platinum may be a continuous or discontinuous coating, usually on a coating of another metal, and this coating(s) will usually encapsulate the particle substrate. This substrate may be low activity activated carbon.

10 Claims, 2 Drawing Sheets

SMOKING ARTICLE AND FILTER THEREFOR

FIELD OF THE INVENTION

This invention relates to smoking articles such as cigarettes and filters for such articles.

BACKGROUND OF THE INVENTION

The invention is concerned with the improvement of the filter in or for such an article by using platinum metal therein.

A certain amount of prior art exists on the use of transition metals in filters of smoking articles. Most of it stresses the alleged catalytic effect of the presence of such metals and has concentrated on presenting those metals in as active a form as possible.

Examples of this are seen in U.S. Pat. No. 4,317,460 and in a paper of the Research Laboratories of Eastman Chemical Products entitled "Results of Experimental Work to Remove carbon monoxide from a mixture of oxygen and nitrogen by Use of Modified Cigarette Filters", publication of which appears to have occurred in March 1978.

These publications were concentrating on the removal of carbon monoxide by catalytic oxidation. In U.S. Pat. No. 4,317,460 the supports used are microporous supports characteristic of catalysts, namely alumina or zeolites and the disclosure stresses the importance of distribution of the chosen metals throughout and within the support material, and also the importance of the generation of activated surfaces by the crushing of pre-impregnated pellets.

One of the metals mentioned is platinum but only in mixtures with other metals and especially in mixtures with rhodium, rhenium or tin. Such mixtures are intimate and as far as possible evenly distributed in the supports.

In the "Results of Experimental Work . . ." paper the author studied the effects of various oxidative catalysts including manganese dioxide and palladium. The study concluded that the carrier was a controlling factor and showed that platinum gave about the same results as palladium when borne on alumina but when borne on other materials no activity was observed.

In JP-B-82-011630 a cigarette filter has a layer of palladium or platinum supported on a composite of cement and powdered activated carbon and covered by second and third layers of respectively further activated carbon and an oxidant. This filter is said to remove carbon monoxide and oxides of nitrogen from cigarette smoke.

Thus the picture emerges of various elaborate and expensive suggestions for the catalytic manipulation of gaseous components of cigarette smoke in the filter by oxidation on transition metals.

SUMMARY OF THE INVENTION

The present invention however provides an article where platinum is presented in a form which is not recognised as particularly "active" but which is found to have an unexpectedly valuable and selective effect.

According to the invention, a smoking article filter includes particles of granular substrate coated with platinum metal thereon. The substrate may be carbon, a magnesium silicate such as Sepiolite (TM), or plastics, ceramic or glass beads. When the substrate is carbon, a low activity activated carbon can be employed since this is more easily coated with a smooth and therefore reflective and attractive coating. The platinum coating may be an encapsulating coating but will preferably be superimposed upon another coating as, for example, of copper, silver, tin, gold or other suitable metal which encapsulates the substrate. The platinum coating may preferably be achieved electrochemically, but physical treatment by sputtering is possible. Production of platinum coatings chemically from its salts is also possible. Electrochemical deposition will usually require the presence of an intermediate gold and/or silver layer on a base of copper, for ease of production.

Either of these processes will affect the activity of the material of the substrate because this is a surface treatment and no further breaking down of the particles (other than accidentally) is envisaged. Indeed, the presence of the metal coating whether of platinum alone or of platinum and other metals will have an effect in preventing unwanted breakdown of substrate granules.

In any case the product obtained is one bearing upon the superficial surface only an essentially continuous layer of at least one metal and including platinum. However if more than one metal is present, the metals will be in discrete layers and not in intimate atomic admixture.

The coating of the particle will preferably be continuous over the whole of its surface with at least one metal, but in that case due to the cost of the platinum material there would probably be a continuous coating of some other metal such as copper, gold or silver, and sputtering or electrochemical deposition of platinum onto its surface.

In the filter, the platinum-bearing particles can be presented in general admixture in the conventional cellulose acetate or other fibrous filter material or can be admixed therein with conventional untreated activated carbon particles or other conventional particulate filter ingredients, or the platinum treated particles can be segregated axially or radially within the length or cross-sectional area of the filter in order to achieve particular effects upon the smoke in synergy with other elements or parts of the filter, such as zones containing ordinary activated carbon or magnesium silicate or paper. Furthermore, the filter materials may contain internal channels, tubes or the like for physically manipulating the flow of smoke through the filter and into or out of particular zones thereof. Of course, the chemical and physical constitution of the smoke varies as it passes through such a filter having received different treatment in different parts thereof.

BRIEF DESCRIPTION OF THE DRAWINGS

Some particular embodiments of the invention are seen in the accompanying drawings, wherein.

DESCRIPTION OF PREFERRED EMBODIMENTS

Figure 1:
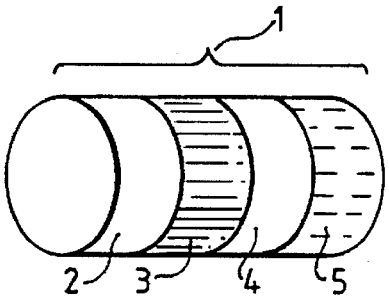
FIGS. 1 to 13 are perspective and partly cutaway views of respective embodiments and FIG. 14 is a perspective view of a cigarette. Single or double wrappers of the filters are not shown in FIGS. 1–9. The mouth end of each filter is to the left in FIGS. 1 to 13.

In FIG. 1 a filter 1 has longitudinally successive zones of cellulose acetate 2, black acetate (cellulose acetate incorporating carbon black) 3, paper 4 and a zone 5 of cellulose acetate tow with activated carbon particles admixed therein. Such a zone 5 is sometimes known as a "dalmatian". These activated carbon particles are granules of average size 0.25 to 0.45 mm, or rods of average length 3 mm and radius 0.8 mm, coated with platinum by a sputtering or electrochemical process to wholly or partially cover their surfaces and so as to decrease their surface/weight ratio. The process may also be used to produce plated low activity carbon (e.g. carbon tetrachloride number 35–45) in addition to higher activity grades. Granular sizes may range from less than 0.5 mm to over 3 mm.

The amount of platinum may be in the range of approximately less than 0.02% to greater than about 2%, preferably 1 to 1.5%, most preferably about 1.1% by weight of the coated substrate.

Figure 2:
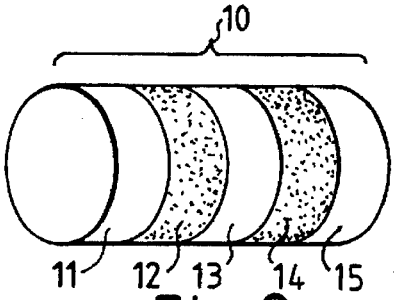

In FIG. 2 a filter 10 has longitudinally successive zones of different media. Zones 11, 13, 15 are of paper or cellulose acetate. Zones 12, 14 are of activated carbon particles. In one or more of zones 12 and 14 the carbon particles may be replaced by or admixed with Sepiolite (TM) particles. The carbon particles are electrochemically coated first with a base layer of metal, here copper, to a thickness of less than 10 μm, suitably 0.3 μm, which effectively completely closes the surface of the particles. Successive layers of silver and gold are then deposited electrochemically, if desired. Platinum metal is then electrochemically coated on the outer layer, to a thickness of less than 10 μm, suitably 0.3 μm, although platinum thicknesses of approximately 0.003 μm or less may be produced. Alternatively, this filter may only have three zones (for example 11, 12 and 13).

Figure 3:
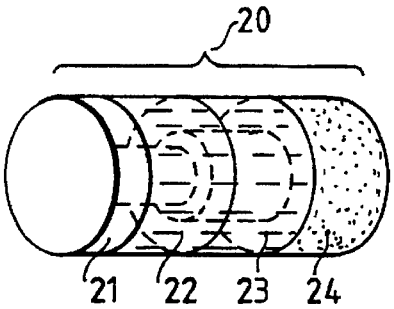

In FIG. 3 a filter 20 has four zones 21, 22, 23 and 24. Zone 21 is cellulose acetate. Zones 22 and 23 have special core portions of respectively different diameters and which include platinum-coated carbon particles as in zone 5 of FIG. 1. Zone 24 is of carbon-bearing paper or black cellulose acetate containing carbon particles.

Figure 4:
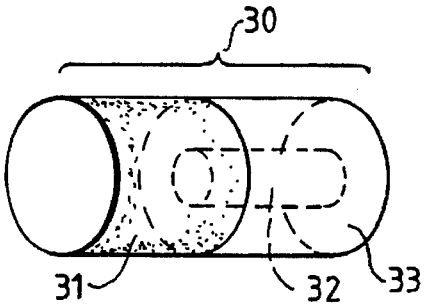

In FIG. 4 a filter 30 has a zone 31 with an annular inclusion of carbon particles with diameter range 0.05 to 0.3 mm, coated with metals, including platinum to a level of less than 2% by weight, suitably a range of approximately 0.02% to 1.1%. In yet other embodiments the annular inclusion may comprise metallised carbon particles of a size range approximately less than 0.5 mm to 3 mm or greater according to the usage envisaged e.g. in a "dalmation" sizes of 0.05–0.45 mm or in a triple cavity, sizes of 0.5–1.5 mm.

The adjacent zone has a high-density cellulose acetate core 32 surrounded by cellulose acetate of lower density 33.

Figure 5:
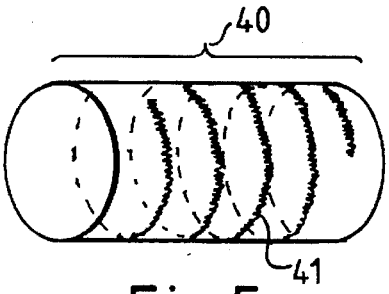
Figure 7:
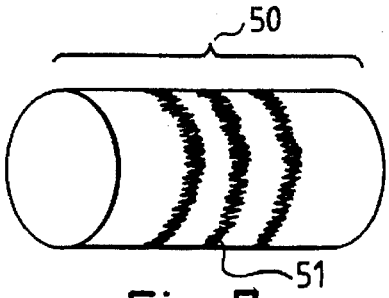

FIGS. 5 and 7 show how filters 40 and 50 may have platinum-coated granular inclusions similar that of zone 31, FIG. 4, bug in a spiral conformation 41 or as adjacent rings S1, in cellulose acetate filters.

Figure 6:
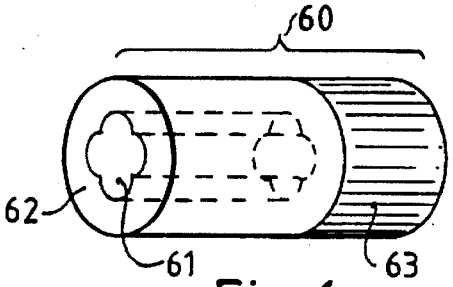

In FIG. 6 a filter 60 has a zone with a low density core 61 and a high density outer layer 62. Activated carbon particles electrochemically or sputter-coated with platinum to less than 2% by weight, suitably in the range of approximately 0.02% to 1.1%, are admixed into black acetate zone 63.

Figure 8:
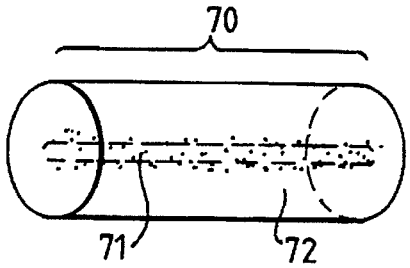
Figure 9:
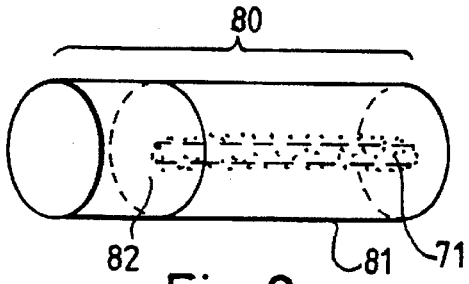

FIG. 8 shows a filter 70 in which the metallised carbon particles previously described in FIG. 4 (which may be in admixture with carbon) are glued to a thread 71 that is longitudinally located within a cellulose acetate or paper filter 72. The thread may be concentrically or eccentrically located. This material may be included as a segment within other multi-zoned filter embodiments e.g. FIG. 9 which illustrates such a filter 80 incorporating this type of segment 81 and a mouthpiece of cellulose acetate or paper 82.

Figure 10:
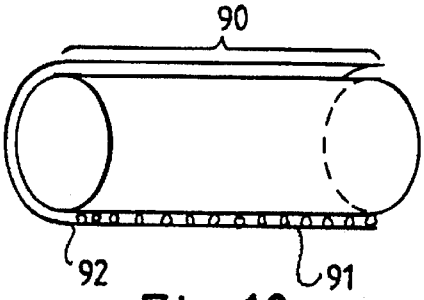

In FIG. 10, a filter 90 has an outer zone of plug wrap in which the metallised carbon particles 91 previously described in FIG. 4 (which may be mixed with carbon) are glued to the surface of the plug wrap 92 prior to forming the filter. This surface becomes the inner surface in contact with the filter material after forming. The granular metallised carbon or mixture may form a continuous linear conformation longitudinally along the filter (FIG. 10) or, as in filter 100 (FIG. 11) be glued to the plug wrap 92 intermittently to form patches 101.

Figure 11:
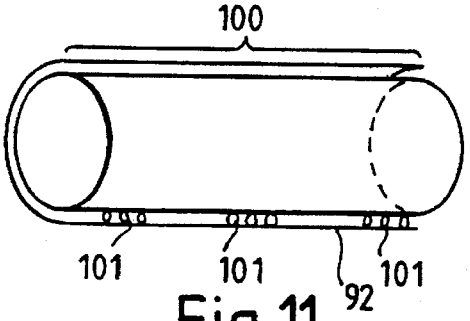
Figure 12:
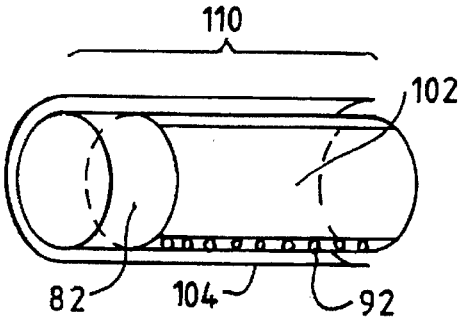
Figure 13:
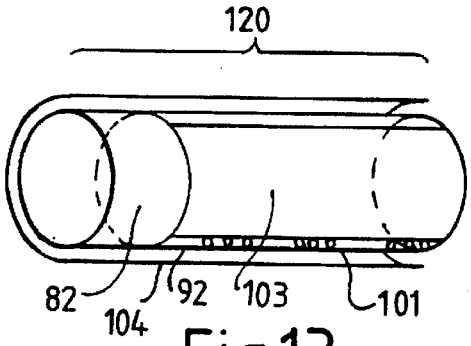

FIGS. 12 and 13 show how filters 110 and 120 may incorporate segments of glued granular materials described in FIGS. 10 and 11 with other multi-zoned filter embodiments. For example, filters 110 and 120 incorporate a cellulose acetate or paper mouthpiece 82 attached to such segments 102 and 103 by outer plug wrap 104.

Figure 14:
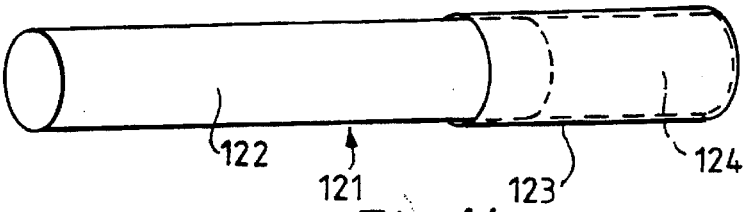

In FIG. 14 a cigarette 121 has a tobacco rod 122 joined by tipping paper 123 to a filter 124, which is any embodiment of the present invention.

A particularly suitable metal coating, applicable to any of the previously described embodiments, comprises sequential layers of copper, silver, gold and platinum. Suitable thicknesses are 0.3 μm, 25.5 μm, 0.8 μm, and 0.3 μm, respectively, giving percent by weight of 0.5, 51.0, 3.1, and 1.1, respectively. In other configurations, the thicknesses of sequential copper, silver, gold and platinum may range approximately 4–6 μm, 0.25–25.5 μm; 0.1–2.0 μm and 0.001–0.3 μm respectively, giving a percent by weight range of 50–70%, 3.4–51%, 0.6–14.3% and 0.003–1.1% approximately, respectively. Also, platinum may be deposited directly on the silver layer, thus omitting the gold stage, if desired.

Chemical analysis of the mainstream smoke showed that little or no reduction in vapour phase components took place after filtering through low activity activated carbon of a size between 15 and 70 mesh.

However, the Tables attached show how what could be expected to be an almost completely inactive filter ingredient, at least at the temperatures within a cigarette filter, in fact has a most surprising and selective activity.

Smoke from the tobacco rod contains four main bands of components: permanent gases, volatiles (i.e. vaporized liquids), semi-volatiles and non-volatiles, the latter two being regarded together as particulates. Catalytic activity in the prior art has been allegedly observed in relation to permanent gases such as carbon monoxide and oxides of nitrogen.

The present results show than the platinum-bearing particles of the present filters at the temperature at which they are used, i.e. room temperature or slightly above, have no observable effect on permanent gases but an extremely marked effect in reducing the quantity of volatiles passing through the filter. No effect was observed on nicotine, a semi-volatile smoke component.

In each experiment the base was a commercial filtered cigarette including activated carbon. A cavity was formed in the filter and the test materials inserted. In the experimental results, the increase in volatiles noted when controls A and B were tested was because these replaced some of the high activity carbon with uncoated low-activity carbon. The reduction in volatiles achieved in result C, the filter embodying the invention, is remarkable.

Results were as follows:

TABLE 1

| SAMPLE CIGARETTE | CAVITY MATERIALS | AVERAGE CHANGE Δ % (1) |
|---|---|---|
| A | Partial replacement by low activity carbon only | +10.3 |
| B | Partial replacement by low activity carbon only, but approximately 2 × the weight of carbon in the filter cavity of SAMPLE A. | +1.5 |

TABLE 1-continued

| SAMPLE CIGARETTE | CAVITY MATERIALS | AVERAGE CHANGE Δ % (1) |
|---|---|---|
| C | Partial replacement by low activity carbon plus platinised carbon additive (2) (approximately by weight) 35% | −23.1 |

Table 1 Notes
(1) Average yield change of 28 mainstream volatiles
(2) Platinised carbon rods of average length 3 mm and radius 0.8 mm coated with platinum to a thickness of approximately 0.3 μm; 1.1% platinum by weight.

Table 1 illustrates that the filters of Samples A and B were more inefficient than the base regarding volatiles as indicated by an average increase in the mainstream yield of volatiles of 1.5 to 10.3%. This is due to the low activity carbon incorporated in the filter cavity resulting in a less efficient volatiles filtering than the base. Even when the weight of carbon in the cavity is doubled (Sample B), the average volatiles yield is still increased by 1.5% compared with the base.

The experiments demonstrate that the effect of low activity carbon on the removal of mainstream volatiles components is minimal.

However, Sample C which contains the platinised carbon additive in addition to low activity carbon in the cavity shows a significant increase in filter efficiency for mainstream volatiles as demonstrated by the 23.1% decrease in the average yield of these substances compared with the base.

The mainstream volatiles were sampled over 28 ingredients, the principal ones of which and their percentage changes are seen as follows:

TABLE 2

| | Δ % change compared to base | | |
|---|---|---|---|
| | Ingredient | | |
| Cigarette | Acetaldehyde | Acetone | Methyl-Ethylketone |
| A | +2 | +12 | +15 |
| B | −4 | +2 | +6 |
| C | −16 | −21 | −20 |

The effects on permanent gases and nicotine (a semivolatile) can be seen from Table 3 to be zero or negligible.

TABLE 3

| | Δ % change compared to base | | | |
|---|---|---|---|---|
| | Mainstream Smoke | | | |
| SAMPLE | Δ % NFDPM | Δ % Nicotine | Δ % CO | Δ % NO |
| A | −4.6 | 0.0 | +8.8 | +7.8 |
| B | −4.6 | 0.0 | +11.3 | +6.9 |
| C | +3.1 | 0.0 | +8.8 | +6.9 |
| | Particulates | A semi-volatile | Permanent gases | |

We claim:

1. A filter for selective reduction of volatiles in mainstream smoke of a smoking article, the filter comprising particles each of which comprises a substrate bearing on its outer surface for exposure to said smoke coated platinum which is essentially continuous.

2. A filter according to claim 1 wherein the substrate is encapsulated in a coating layer.

3. A filter according to claim 2 wherein the encapsulating layer is said coated platinum.

4. A filter according to claim 2 wherein the encapsulating layer is of a metal other than platinum, and said coated platinum is coated on a surface of the encapsulating layer.

5. A filter according to claim 1 wherein the particles have a smooth and reflective appearance.

6. A filter according to claim 1 wherein the substrate is a low activity activated carbon.

7. A cigarette incorporating a filter according to claim 1.

8. A method of selectively reducing volatiles in mainstream smoke of a smoking article comprising passing said smoke through a filter comprising particles each of which comprises a substrate bearing on its outer surface for exposure to said smoke coated platinum which is essentially continuous.

9. A filter according to claim 4 wherein the coated platinum is a plurality of areas of essentially continuous coatings.

10. A filter according to claim 1 wherein said coated platinum is not in intimate atomic mixture with another metal.

* * * * *